United States Patent [19]

Siegrist

[11] 4,170,963

[45] Oct. 16, 1979

[54] BOILERS

[76] Inventor: Eugen J. Siegrist, Neufeldstrasse 5, Bern, Switzerland

[21] Appl. No.: 878,456

[22] Filed: Feb. 16, 1978

[30] Foreign Application Priority Data

Feb. 18, 1977 [CH] Switzerland ..... 2023/77

[51] Int. Cl.[2] ..... F22B 7/12

[52] U.S. Cl. ..... 122/33; 122/182 S

[58] Field of Search ..... 122/33, 37, 121, 122, 122/182 R, 182 S, 182 T

[56] References Cited

U.S. PATENT DOCUMENTS

| | | | |
|---|---|---|---|
| 2,568,781 | 9/1951 | Watts | 122/182 |
| 2,787,256 | 4/1957 | Ilane | 122/182 |
| 3,007,457 | 11/1961 | Ospelt | 122/37 |

*Primary Examiner*—Kenneth W. Sprague
*Attorney, Agent, or Firm*—Watson, Cole, Grindle & Watson

[57] ABSTRACT

A boiler has a cylindrical firebox surrounded by a water jacket which, in turn, is surrounded by a hot water boiler. The firebox has a cylindrical primary furnace, in which a burner for liquid or gaseous fuel is located, and a cylindrical secondary furnace which is of greater diameter than the primary furnace. Combustion gases are removed from the secondary furnace through fire tubes arranged in a circular array around the fire box and extending axially thereof through the water jacket. The water jacket and hot water boiler are separated by a partition which lies against the circular fire tube array inside the water jacket.

8 Claims, 2 Drawing Figures

BOILERS

The invention relates to a boiler with a firebox extending along its central axis and a burner arranged at one end thereof on the central axis for gaseous or liquid fuels, as well as fire tubes extending from the other end, disposed in a circle which go through an annular water jacket surrounding the firebox and opening out at the end where the burner is disposed into an annular boiler gas collector channel, as well as with a hot water boiler.

Many of the boilers found nowadays in operation, corresponding to the above-described type, are constructed as double furnace boilers or as change-over or interchangeable furnace boilers so as to be able as desired to burn solid fuel apart from liquid or gaseous fuel. These boiler constructions are to be regarded, however, as compromise solutions, as though indeed suitable for solid as well as liquid and gaseous fuel, they are conceivably unfavourably constructed for the latter, although they are precisely operated almost exclusively with liquid or gaseous fuels, while the burning of solid fuel is resorted to only in emergencies. For the equivalent boiler performance the firebox for the combustion of solid fuel must be considerably bigger than for the burning of liquid or gaseous fuels. For the last-mentioned the ideal firebox is embodied in connection with a high specific firebox charge for which the flame ambient temperature rises to over 760° C. and furthermore, on account of the dimensions of the firebox, a full combustion of the flame is possible without touching the heating surfaces, as it is only under such conditions that it is possible to avoid in the flue gases soot and imperfectly burned oil derivatives. With the above-mentioned double combustion boilers or change-over or interchangeable boilers, the extremely important high firebox charge for oil operation with the necessary flame ambient temperature of at least 760° C. cannot be achieved as the flame, in the firebox whose dimensions are too great, cools down considerably, as a result of which soot and traces of oil derivatives that have not been burnt get into the waste gases. Also, in the case of the types of boilers last mentioned, it is possible for unburnt fuel oil condensates to form under the open grate, leading also to foul-smelling waste gases. For economic considerations it is therefore exceedingly inappropriate to gloss over the above-described drawbacks of double combustion boilers or of the change-over or interchangeable boilers with a firebox that is too large for oil operation, when these boilers are after all, almost without exception, run on liquid and/or gaseous fuel.

An object of the present invention is therefore to provide a boiler suitable only for operation with liquid or gaseous fuel, whose firebox is specifically accurately charged so that a flame ambient temperature of over 760° C. is reached, and is also accurately geometrically dimensioned for the flame to burn out freely, in such a manner that soot and incompletely burnt oil derivatives are avoided in the waste gases. A further object is to achieve a low waste gas temperature to reduce heat losses further and to achieve a firing operation with as little noise as possible. Furthermore, the objective hereof is to provide a boiler that is easy to clean and which in addition is easy to install, and is, furthermore, easy to produce in a constantly normal design independently of the various local possibilities of connection to a chimney. A boiler intended only for operation with liquid or gaseous fuel is also easier to regulate in optimum manner and has also a better degree of fire effect.

For the achievement of these objects the boiler of the type first defined above is, according to the invention, characterised in that the firebox, between the end facing the burner and the opposite end, widens by steps from a cylindrical primary furnace into a cylindrical secondary furnace with greater diameter relatively to the primary furnace, and in that a coaxially arranged annular hot water boiler adjoins the annular water jacket surrounding the firebox for the boiler water along a separating partition which lies against the circularly disposed fire tubes.

The advantage of the two furnaces of different sizes lies in that in the primary furnace whose diameter is from 10 to 20% greater than the flame diameter, which with the burners normally available in the trade is of substantially the same size, a flame ambient temperature of about 900° C. is now achieved, which ensures a complete combustion free from soot, and in that furthermore the secondary furnace having a larger diameter is big enough to ensure a full combustion of the flame without a contacting of the heating surfaces taking place, so that the creation of soot and oil derivatives is prevented. For the complete combustion of a flame is impossible when it impacts a heating surface.

The further advantage of the secondary furnace with large diameter is that it has a radiation heat area that is so great, or has a heat transmission that is so great that the flame gases enter the fire tubes (contact heating surface) only at a temperature of 250°–450° C. An additional advantage lies in that the starting impact is absorbed by the great gas volume of the secondary furnace, so that the starting ratio of the burner is helped. In addition the boiler requires a flue of smaller dimensions which in turn dampens sound and leads to smaller heat losses, and which the waste gases leave at a greater speed so that they reach the higher layers of the air, this being aimed at for environment protection reasons.

Preferably, the primary heating surface surrounding the smaller furnace and the secondary heating surface surrounding the greater furnace have a size ratio of 1:2.5 to 1:4, the diameter of the greater furnace being appropriately 45 to 60% greater than the diameter of the smaller furnace. The length of the bottom furnace can be calculated from the indicated size ratio of the heating surfaces and the diameters of the two furnaces. Furthermore, the after-heating surface provided by the fire tubes is preferably about 150% greater than the primary and secondary heating surfaces together.

In a further preferred embodiment the boiler gas collector duct is an annular groove-shaped recess in a firebrick lining which is surrounded by a metal bonnet and forms with this the front wall of the boiler at the burner end. This firebrick lining has a radially slantingly outwardly directed opening for connecting up a boiler gas exhaust pipe and at the centre a further opening, coaxial with the central axis of the boiler, through which the burner flanged-on outside on the metal bonnet of the front wall extends. Furthermore, the front wall of the boiler made up of the metal plate bonnet and the firebrick lining may be swivelled upwardly towards opposite sides by means of hinges facing one another disposed on the edge of said front wall. By means of this construction with a boiler front wall which can swivel as an unit, the boiler is very accessible for cleaning operations and the front wall and burner can be easily exchanged.

The boiler may also be produced in a lying construction, with the primary and secondary furnace being disposed horizontally one behind the other.

If need be, the boiler may also be fired electrically when, e.g. in war time, no liquid or gaseous fuel is available. For the purpose, after the removal of the firebrick lining with the boiler gas collector duct, electric heating elements can be inserted into the fire tubes, in such a manner that the boiler can be operated electrically in this way.

Further particulars and advantages of the invention will be obtained from the following description and the drawings in which a method of embodiment of the heating boiler is represented purely for the sake of example.

In the drawings

Figure 1:
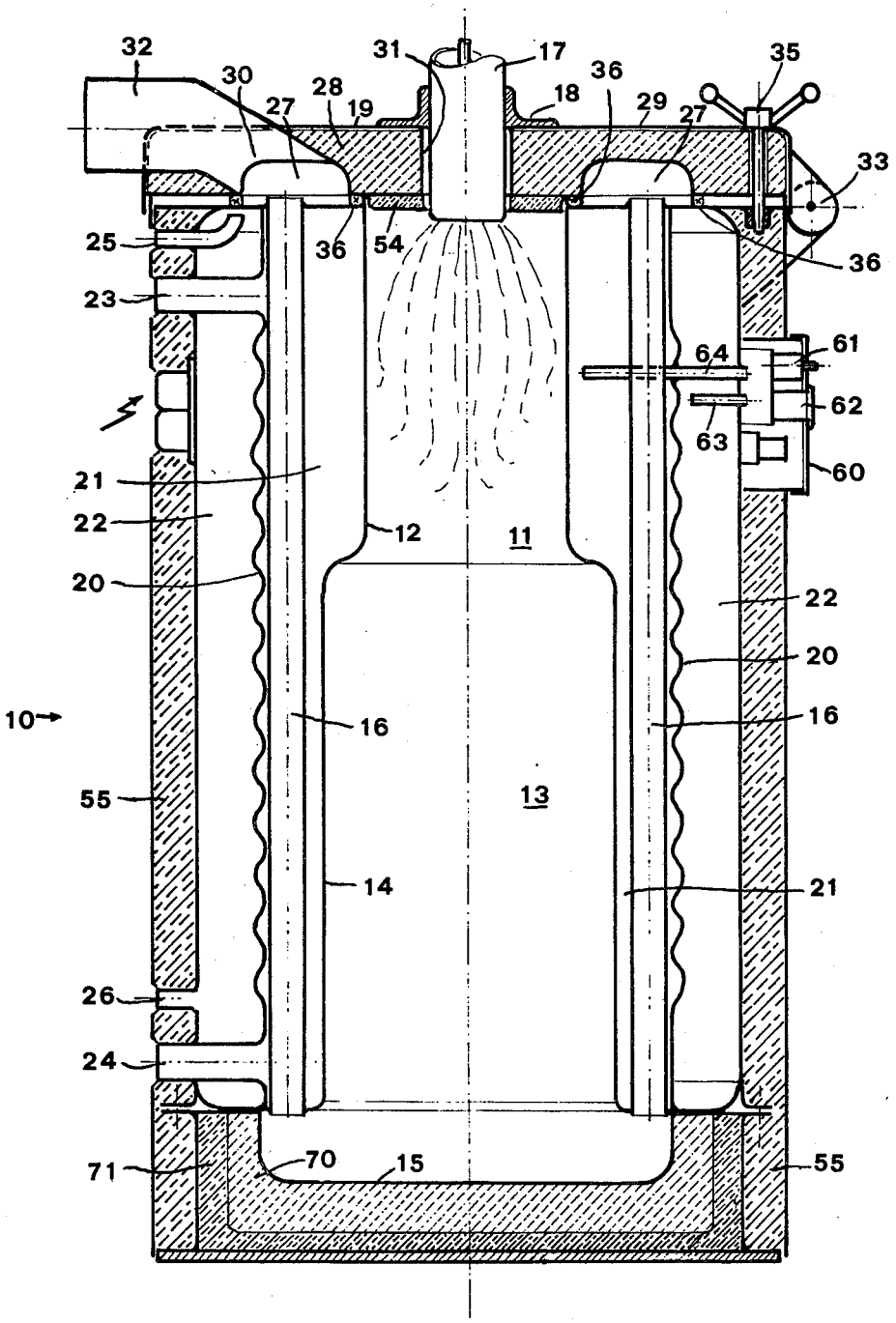
FIG. 1 is a longitudinal sectional view taken through the boiler along line I—I of FIG. 2 with partial sections along line II and III drawn staggered.

The vertically-standing boiler generally designated 10 in FIG. 1 has an upper primary furnace 11 with a cylindrical primary heating surface 12 and a bottom secondary furnace 13 connecting therewith, having also a cylindrical secondary heating surface 14. The furnace 13 is closed off below by means of a bottom 15 which includes a firebrick lining 70 surrounded by an insulation 71.

To determine the size of the primary heating surface 12 an empirically arrived-at temperature factor is taken as a starting point. For the construction of a boiler with a specific degree of heating efficiency, a calculation is made in the first instance of the quantity of fuel oil required for this purpose, there being taken as a basis the degree of firing efficiency of 95% attainable with the boiler of the type described here. Because of the complete insulation of the boiler heat losses can be neglected in the calculations. As one kilo of light fuel oil represents at least 10,000 kcal, it will be possible, by calculation and taking the firing efficiency of 95% into account, to determine the hourly quantity of oil in liters which is necessary for a specific boiler performance. In the case of an already existing boiler with a specific firebox size it will be possible, by measuring with thermo-elements directly alongside the firebox, to determine whether the high flame ambient temperature aimed at of about 900° C. has been reached. If this is the case, then the heating surface of this firebox has the right dimensions for fulfilling the condition laid down. The quotient of the firebox heating area in square meters and the hourly amount of oil in liters then represents the temperature factor. For every other boiler performance the necessary size of the primary heating area of the upper furnace will then be arrived at with the hourly amount of oil in liters calculated therefor by multiplying by the temperature factor.

The diameter of the upper furnace 11 is selected to be 10 to 20% greater than the flame diameter which with all the burners available in the trade with the same output is substantially about the same. The length of the furnace 11 is calculated from the diameter of the furnace 11 determined in this way and from the size of the primary heating area 12.

The primary heating area 12 of the furnace 11 and the secondary heating area 14 of the furnace 13 should be in the ratio of 1:2.5 to 1:4. The diameter of the furnace 13 is selected so as to be 45 to 60% greater than the diameter of the furnace 11. If the area and the diameters have been ascertained, the length of the furnace 13 can be calculated. The size thus determined and in particular the length of this furnace ensure that the flame gases enter the fire tubes at the desired temperature of 250°–450° C. (with full combustion without contacting the heating surfaces).

Figure 2:
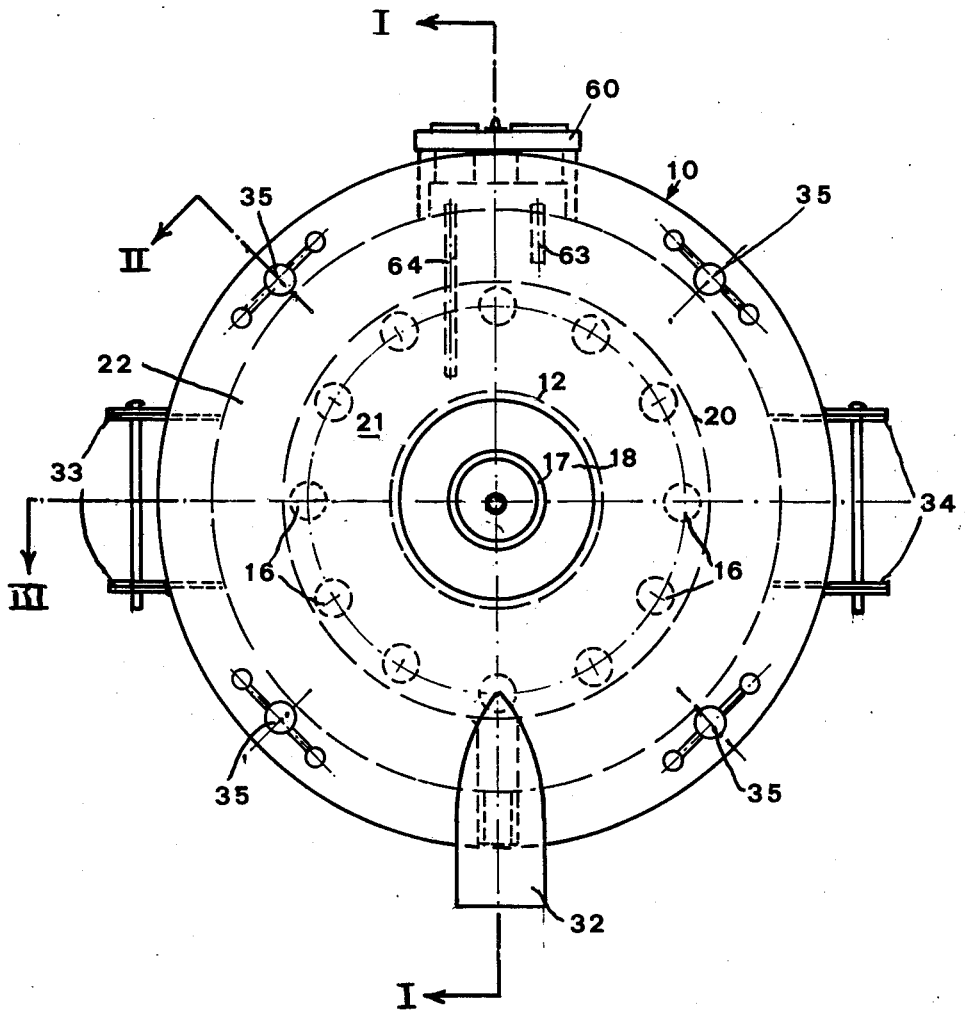
FIG. 2 is a top plan view of the boiler FIG. 1.

The fire tubes 16 which, as may be seen in FIG. 2, are disposed along a circle come out from the bottom front side of the furnace 13. These fire tubes provide an after-heating surface which is selected to be about 150% greater than the primary and secondary heating areas together. The number and the diameters of these fire tubes 16 are calculated in such a manner that with a boiler gas speed of 1 to 2 m/sec. friction losses of not more than +2 mm water column develop and the exhaust gas temperature at the end amounts to 100°–200° C. As a basis for the calculation there has been taken the air requirement of the burner in Nm3 for a 1.2 to 1.3 times air excess for "extra light" fuel oil.

As will be seen in FIG. 1, the burner tube 17 of the burner not represented in more detail in the drawing protrudes from the top into the furnace 11. The burner tube 17 is fixed by means of the burner tube flange 18 onto the front wall 19 of the upper part of the boiler 19, which for inspection and cleaning of the furnaces and of the fire tubes can be swivelled upwardly to the side, as will be further explained hereinbelow.

Externally, against the fire tubes 16 arranged in a circle, there lies a corrugated-tube separation wall 20, which is made of a rustless material and has a relatively small wall thickness. This relatively thin separation wall rests against the fire tubes which constitute a supporting framework for the separation wall. The separation wall separates the annular space 21 which surrounds the furnaces 11 and 13 and which contains the boiler water, from the hot water boiler 22 extending radially outwardly and having in cross-section the shape of a circular ring. As the thin-walled separation wall 20 is supported on the fire tubes 16 it cannot be pressed in by any higher pressure developing in the hot water boiler 22. On the other hand, as a result of the pressing of the separation wall against the fire tubes there is obtained a very good heat transmission along the fire tubes. Furthermore, the small material thickness of the separation wall 20 makes a "breathing" of the boiler possible, i.e. a limited to and fro movement of the separation wall in a radial direction, when and because the boiler pressure on consuming boiler water varies, so that the lime contained in the water and being deposited on the separation wall falls off the latter.

The boiler water leaves the boiler water space 21 via lateral piping 23 passing through the boiler, and after circulation through the heating system enters below via ducting 24 through the boiler into the boiler water space 21. As the water is then colder corrosion phenomena could arise in the bottom portion of the boiler as a result of sweating, and because of this at least the fire tubes 16 are made of acid-resistant steel. An upper pipe 25 through which the hot water leaves the hot water boiler 22, as well as a lower pipe 26 for the admission of cold water are connected to the hot water boiler 22.

The fire tubes 16 arranged in a circle open out, at the burner end of the boiler, into a boiler gas collector duct 27 which is defined by an annular groove-shaped recess in a firebrick liner plate 28. This firebrick plate is encompassed externally by a metal plate bonnet 29 and forms together with this the front wall 19 at the burner end of the boiler. This boiler front wall has an opening 30 extending from the annular groove shaped recess 27 in a radial direction and slants upwardly for the reception of a boiler gas exhaust pipe 32. Also, plate 28 and bonnet 29 have a central opening 31 coaxial with the central axis of the boiler through which the burner 17 extends. The front wall 19 of the boiler is connected with the remainder of the boiler by means of pivoting hinges 33 and 34 which are fixed on the edge of the front wall where they are placed diametrically opposite each other. The provision of the two oppositely-placed hinges permits the front wall to be swivelled upwardly toward opposite sides, one of the hinges therefore being inoperative during such swivelling action. It is therefore possible depending on, the space conditions at the situs of the boiler, to pivot the front wall towards one side or the other, so as to carry out cleaning or inspection operations. The front wall of the boiler is pressed against the upper side of the remainder of the boiler by means of four lever screws 35 disposed about the boiler. Seals 36 disposed on the inner side of the firebrick lining plate 28 are used for sealing. Mounted on the inner side of the firebrick lining plate 28 in the area of the furnace 11 is a heat shield 54 which is made of a material developed for space travel and which shuts off the heat from the furnace to such a considerable extent that the boiler at this location evidences only very small heat losses.

To reduce heat losses use is made furthermore of an insulating shroud 55 which surrounds the boiler completely and which extends from the upper front wall 19 of the boiler right down to the bottom surface on which the boiler stands. With this shrouding the boiler acquires a smooth external surface from which there projects radially only at the upper portion of the boiler an instrument panel 60 behind which regulating devices are arranged which comprise inter alia registration and regulation instrument 61 and 62 which are in each instance connected electrically with a measuring gauge 63 protruding into the boiler (hot) water or with a measuring gauge 64 protruding into the main boiler water.

The boiler described hereinabove has, as compared with the other hitherto known boilers of this type, numerous advantages which consist inter alia in that the firebox of the boiler is charged specifically accurately, in such a way that a flame ambient temperature of over 760° C. is reached, and the firebox is furthermore correctly geometrically dimensioned for the flame, so that the latter can burn freely, with the complete avoidance of soot and incompletely burnt oil derivatives in the waste gases. The boiler having the high flame surrounding temperature is operated with slight excess pressure of about 1 to 2 mm water column in the primary furnace, and the combustion gases are pressed out by the burner out of the secondary furnace and leave the boiler with a waste gas temperature of 100°–120° C., the gas speed in the fire tubes being 1–2 m/sec. On account of the small resistance of the boiler the flue draught cannot any longer work back into the furnace. The boiler is therefore independent of the flue draught. Therefore, it is possible to use a flue with small diameter, preferably made of steel, which the waste gases pass at a relatively low temperature, as a result of which only small heat losses arise here. With this boiler fuel oil is saved and the environment is less charged.

The bottom of the boiler consisting of firebrick acts as a reverse-radiation surface for the flame and as a result promotes the high temperature of the final combustion of the flame tips. The bottom consisting of firebrick possesses furthermore the advantage that the sulphurous condensates which form on a cold start of the boiler or on a possible operation below rated temperature and which drop off the vertical heating surfaces are eliminated on the firebrick bottom and thus eliminated without danger.

The manufacture of the boiler in an open tubular form open at the top and below, which is then completed by the bottom and the upper front wall, is simpler and with less problems than the manufacture of a boiler with a water-cooled double bottom.

The boiler is also very easy to service as regards cleaning of the furnaces and of the fire tubes, as cleaning may be effected from the top and, since all the dirt collects on the bottom below the furnace, it may be removed by suction. In order to clean the boiler, it will be sufficient to release the lever screws on the upper front wall for swivelling this and the burner upwardly, in such a manner that the firebox and all fire tubes are freely accessible.

I claim:

1. A boiler, comprising a firebox with a central axis, a gaseous or liquid fuel burner arranged at one axial end of the firebox on the central axis thereof, first wall means surrounding the firebox to define an annular water jacket therearound, a circular array of fire tubes surrounding the firebox and extending axially through the water jacket, means defining an annular gas collector at the burner end of the firebox, the fire tubes communicating at one end with the axial end of the firebox remote from the burner and at their other ends with the gas collector, and second wall means defining a hot water boiler, the improvement wherein the firebox is formed by first and second cylindrical wall portions respectively defining a primary and a secondary furnace having a larger diameter than the diameter of the primary furnace, and a stepped wall portion joining the first and second wall portions, the hot water boiler being annular in form and surrounding the water jacket, the first wall means separating the water jacket and hot water boiler and lying against the circular array of fire tubes.

2. A boiler according to claim 1, in which the first cylindrical wall portion and the second cylindrical wall portion have a size ratio of 1:2.5 to 1:4, the diameter of the second wall portion being 45 to 60% greater than the diameter of the first wall portion.

3. A boiler according to claim 2, in which the fire-tubes provide a heating surface which is 50 to 150% greater than that provided by the first and second cylindrical wall portions together.

4. A boiler according to claim 1, in which the means defining the gas collector comprises a firebrick lining with an annular groove-shaped recess which forms the gas collector, the boiler further comprising a metal bonnet surrounding the firebrick lining and forming therewith a wall of the boiler at the burner end of the firebox, the firebrick lining defining a radially slanting, outwardly-directed opening for connecting to a boiler gas exhaust pipe and having a central opening coaxial with the central axis of the firebox through which the burner extends, the burner being secured by a flange thereof to an external wall of the metal bonnet.

5. A boiler according to claim 4, further comprising two selectively disengageable hinges mounting the wall formed by the metal bonnet and firebrick lining on the second wall means, disengagement of one of the hinges enabling the wall formed by the bonnet and lining to be swivelled open.

6. A boiler according to claim 1, in which the secondary furnace is closed off remote from the burner by a base of firebrick with an insulation.

7. A boiler according to claim 1, in which at least that portion of the firebox impinged on by the spent gas and the fire tubes are made of corrosion-resistant steel.

8. A boiler operating process including the steps of operating a boiler at a furnace temperature of about 900° C., the boiler comprising a firebox with a central axis, a gaseous or liquid fuel burner arranged at one axial end of the firebox on the central axis thereof, first wall means surrounding the firebox to define an annular water jacket therearound, a circular array of fire tubes surrounding the firebox and extending axially through the water jacket, means defining an annular gas collector at the burner end of the firebox, the fire tubes communicating at one end with the axial end of the firebox remote from the burner and at their other ends with the gas collector, and second wall means defining a hot water boiler, the firebox being formed by first and second cylindrical wall portions respectively defining a primary and a secondary furnace having a larger diameter than the diameter of the primary furnace, and a stepped wall portion joining the first and second wall portions, the hot water boiler being annular in form and surrounding the water jacket, the first wall means separating the water jacket and hot water boiler and lying against the circular array of fire tubes, the operating step being carried out at a slight excess pressure of about 1 to 2 mm water column in the primary furnace, forcing gases from the secondary furnace at a temperature of 250° to 450° C. into the fire tubes, and exhausting the forced gases from the boiler at a gas temperature of 100° to 120° C.

* * * * *